US005141052A

United States Patent [19]

Bump

[11] Patent Number: 5,141,052

[45] Date of Patent: Aug. 25, 1992

[54] WELLHEAD STUFFING BOX FOR POLISHED ROD AND ACCESSORIES FOR SAME

[76] Inventor: David L. Bump, 7380 Maple Ter., Traverse City, Mich. 49684

[21] Appl. No.: 745,724

[22] Filed: Aug. 16, 1991

Related U.S. Application Data

[62] Division of Ser. No. 639,595, Jan. 9, 1991.

[51] Int. Cl.[5] ..... E21B 34/02; E21B 33/03

[52] U.S. Cl. ..... 166/80; 137/527; 166/84; 166/97

[58] Field of Search ..... 166/80, 82, 84, 86, 166/87, 95, 97, 325, 385; 137/527, 527.8; 277/2, 19, 30, 59, 72 R, 72 FM, 79, 110, 111

[56] References Cited

U.S. PATENT DOCUMENTS

| | | | |
|---|---|---|---|
| 1,572,394 | 2/1926 | Krebs | 166/86 |
| 2,033,306 | 3/1936 | Schofield | 137/527.8 X |
| 3,211,102 | 10/1965 | Keehan | 137/527 X |
| 3,939,910 | 2/1976 | Bruce | 166/84 |
| 4,099,562 | 7/1978 | Mattoon | 166/80 X |
| 4,299,280 | 11/1981 | Greer | 166/75.1 |
| 4,377,206 | 3/1983 | Chambers | 166/97 |
| 4,889,184 | 12/1989 | Lugtmeier et al. | 166/80 |
| 4,907,650 | 3/1990 | Heinonen | 166/80 |

*Primary Examiner*—Hoang C. Dang
*Attorney, Agent, or Firm*—Christie, Parker & Hale

[57] ABSTRACT

A wellhead stuffing box for a polished rod includes a body with an elongated opening extending through it to receive the polished rod. Packing in the body makes a sliding seal around the polished rod and a static seal against the interior of the body. Internal pushers are provided for compressing the packing with the required force for appropriate sealing, and the internal pushers cannot be changed without disassembling the body.

3 Claims, 5 Drawing Sheets

WELLHEAD STUFFING BOX FOR POLISHED ROD AND ACCESSORIES FOR SAME

This is a division of application Ser. No. 07/639,595 filed Jan. 9, 1991.

FIELD OF THE INVENTION

This invention relates to stuffing boxes secured to wellheads for oil wells produced by reciprocating pumps, and to components for such stuffing boxes.

BACKGROUND OF THE INVENTION

Oil wells are often produced by mechanical pumps when reservoir pressure cannot force oil to the surface. A common method for producing a "pumping" well includes the use of a reciprocating "polished" rod extending up through a stuffing box at the wellhead, and connected at its lower end to a "sucker" rod string extending down to a downhole pump in the well. The polished rod and sucker rod string are reciprocated vertically by a conventional crank mechanism at the surface, and the downhole pump lifts oil to the surface through a well tubing or casing, which usually extends from the producing formation to the wellhead.

The stuffing box includes packing compressed to make a sliding seal against the polished rod to prevent leakage of fluid, such as oil or gas, from the wellhead.

Although the polished rod is highly polished to minimize friction and wearing of the packing, from time to time the packing wears sufficiently to permit fluid to leak past it and into the atmosphere. Such leaks are wasteful and adversely affect the environment.

The typical prior art stuffing box has a conventional packing gland and nut, which can be manually adjusted by field personnel at the wellhead in an effort to control leaks. Manual adjustment by field personnel is subject to human error and variation, often resulting in improper force being applied to the packing material in the stuffing box. If the force is too great, the packing wears prematurely and increases the power required to drive the pump. If the packing is too loose, the stuffing box leaks.

In addition to packing wear, a polished rod occasionally breaks, resulting in the upper portion of the broken rod being pulled up from the stuffing box by the crank. The lower portion of the broken rod and the sucker rod string drop down to the bottom of the pump stroke, resulting in the lower portion of the broken rod dropping clear of the packing in the stuffing box. To avoid loss of reservoir fluids, and to minimize damage to the environment, many stuffing boxes include a flap valve intended to snap shut and close in the well when the polished rod breaks.

Some prior art flap valves include a spring which urges the valve flap toward a closed position, and against the polished rod while the pump is operating. This causes the valve flap to drag along the polished rod surface as the rod reciprocates, resulting in wear on the flap, or damage to the rod, or both. Other flap valves include complicated mechanisms for actuating the flap to close the valve when the polished rod breaks. In another type of valve, the flap is mounted to hang free of the polished rod, and rely only on fluid flow from the well to urge it closed if the polished rod breaks. The latter arrangement avoids complicated mechanisms and undesirable wear of the valve or polished rod, but sometimes is slow-acting, or fails to act at all.

SUMMARY OF THE INVENTION

This invention provides an improved stuffing box constructed with internal means for compressing packing around a polished rod so that with the stuffing box assembled for use in the field, proper compression is automatically and precisely applied to the packing within the box and requires no further adjustment by field personnel. In fact, with this invention, compression of the packing in the stuffing box cannot be changed by field personnel without disassembling the box. This reduces the opportunity for operator error, which could result in setting the packing too tight or too loose around the polished rod.

This invention also provides a stuffing box with a flap valve which does not drag against the polished rod as the rod reciprocates through the stuffing box. If the polished rod breaks, the valve rapidly snaps shut, and solely in response to fluid flow through the box so that no complicated mechanism is required to actuate the valve.

The preferred form of this invention includes a lower housing having an upright passageway extending through it, an upper housing having an upright passageway extending through it, and means for securing the upper end of the lower housing to the lower end of the upper housing to form a stuffing box with an upright passageway extending through it and in which a polished rod may reciprocate. A lower annular packing in the lower housing is adapted to make a sliding seal around the polished rod when the rod is in the passageway. An upper annular packing in the upper housing is adapted to make a sliding seal around the polished rod when the rod is in the passageway. Means are provided to be responsive to the two housings being secured together to compress at least one of the packings and urge that packing against the polished rod when the rod is in the passageway. The other packing means can either be independently set before the two housings are secured together, or compressed by means also responsive to the two housings being secured together.

Preferably, locking means are provided for securely holding the housings in the final assembled condition. The preferred embodiment also includes a fitting for injecting lubricant into a central lubrication chamber around the polished rod and between the two packings. Preferably, a pressure gauge is also tapped into the central chamber to detect an increase in pressure when the lower packing fails or begins to leak, and thus indicate when the stuffing box should be serviced by replacing the lower packing, which normally fails first because it is exposed to wellhead pressure. The upper packing is not normally exposed to wellhead pressure and, therefore, does not suffer any significant wear, except for the time between failure of the lower packing and servicing of the stuffing box to replace the lower packing.

In another form of the invention, the wellhead stuffing box includes upper and lower housings, which each have an upright passageway extending through them, and means for securing the two housings together to form an enclosed stuffing box with an upright passageway extending through the box and in which a polished rod may reciprocate. A lower annular packing in the box is adapted to make a close sliding fit around the polished rod when the rod is in the upright passageway. Lower pushing means within the box engages and urges the lower packing against the polished rod when the rod is in the passageway. An upper annular packing is in the box above the lower packing, and is adapted to make a close sliding fit around the polished rod when it is in the passageway. Upper pushing means within the box engage the upper packing to urge it against the polished rod when the rod is in the box, which is constructed and arranged to enclose the lower and upper pusher means and prevent adjustment of either of them without uncoupling the two housings which form the stuffing box.

In another form of the invention, the wellhead stuffing box includes a body having an upright passageway extending through it and adapted to fit around a polished rod. Annular packing is disposed in the passageway and adapted to make a sliding fit around the polished rod when it is in the passageway. A valve seat carried by the body extends around the passageway, and a valve flap is mounted in the body to pivot about a substantially horizontal axis adjacent the valve seat. The valve flap has a recessed portion spaced from the pivot axis and adapted to fit around part of the rod when the rod is in the passageway. Means are provided for holding the flap valve so the recess portion fits around part of the rod when the rod is in the passageway. Preferably, the flap valve is held so that it does not contact the rod as the rod reciprocates in the stuffing box.

An accessory to the invention is an annular split bearing adapted to fit snugly in the stuffing box and around the polished rod to align the rod collinearly with respect to the longitudinal axis of the annular packing within the box to minimize wear and friction. The split bearing includes a first wall segment in shape of a semicylinder, and a second wall segment substantially the same size and shape as the first wall segment so the two segments fit together to form an annular bearing adapted to fit within the stuffing box and make a close sliding fit around the polished rod. Preferably, each wall segment includes an outwardly opening groove for receiving an element to fasten the two wall segments together after they are fitted around the polished rod, and to facilitate locating the assembled bearing to make a snug fit in a bearing cavity within the stuffing box. Preferably, each groove is semicircular and located so the grooves form a continuous groove around the outside of the assembled bearing to receive a tape or other securing element which has a radial dimension equal to or less than the depth of the groove in which the element is disposed.

Another accessory to the invention is a split annular bushing, which is made up of a first wall segment in the shape of a semicylinder. An outwardly extending semiannular flange is on one end of the first segment. The bushing includes a second wall segment and semiannular flange substantially identical with the first so the two segments fit together to form an annular split bushing with an outwardly extending annular flange. The assembled split bushing is adapted to fit within the stuffing box and make a close sliding fit around the polished rod.

IN THE DRAWINGS

DETAILED DESCRIPTION OF THE INVENTION

Figure 1:
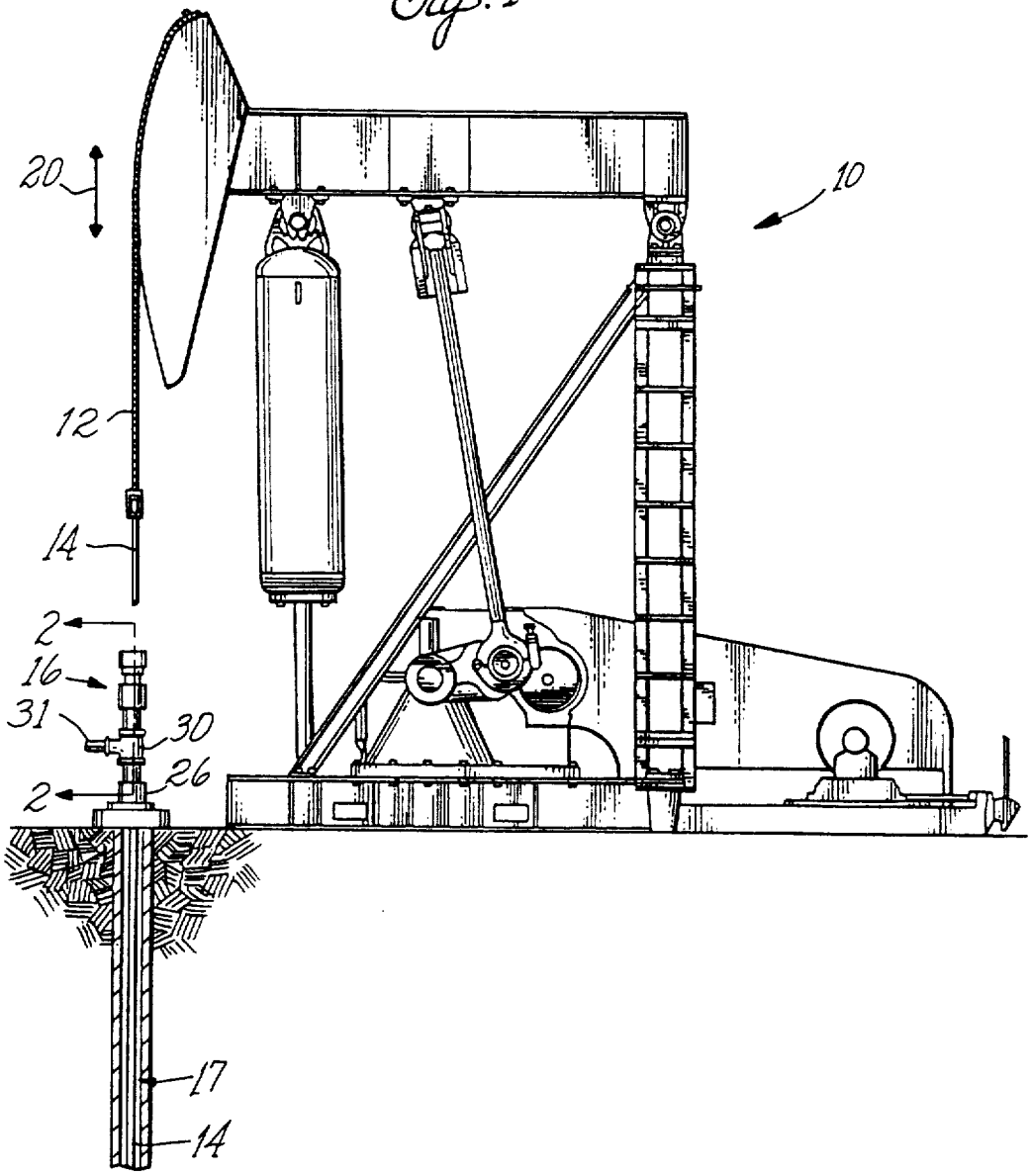
FIG. 1 is an elevation of a conventional pumping system for an oil well in which the polished rod has broken.

Referring to FIG. 1, a conventional pump drive system 10 reciprocates a vertical cable 12 secured at its lower end to the upper end of a broken polished rod 14, which has been pulled out of a stuffing box 16 of this invention. Convention controls (not shown) cause the pumping system to move to the upper end of its stroke and stop when the polished rod breaks. The lower end (not shown) of the broken polished rod is connected to the upper end of a string of conventional sucker rods (not shown) connected at its lower end to a downhole pump (not shown) in a well 17. The sucker rod string drops to move the downhole pump to the bottom of its stroke, resulting in the lower part of the broken polished rod dropping out of the stuffing box.

Figure 2:
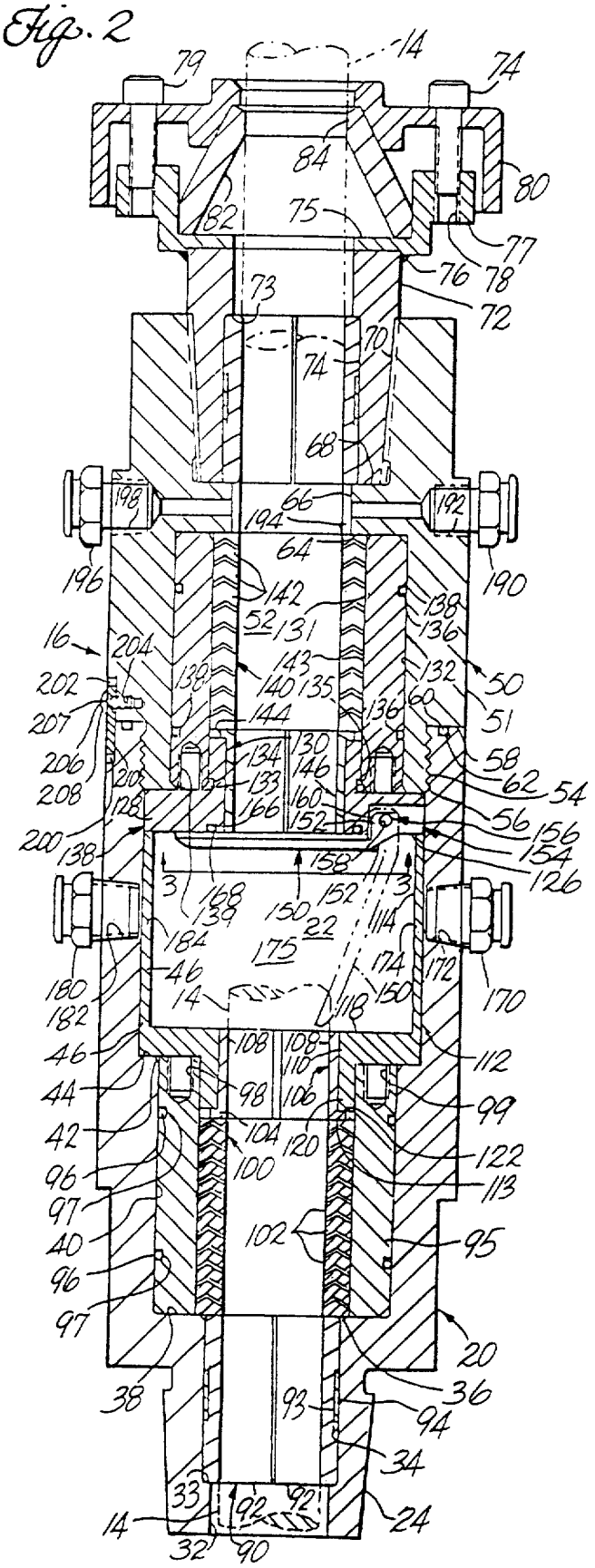
FIG. 2 is a sectional view taken on line 2—2 of FIG. 1.

Referring to FIG. 2, the stuffing box includes a cylindrical lower housing 20 with a vertical elongated cylindrical passageway 22 extending through it. External threads 24 on the lower end of the lower housing are adapted to thread into the upper end of a wellhead 26 of the well, which extends down into an oil producing formation (not shown). The wellhead includes a production tee 30 connected to a gathering line 31, which transfers fluid pumped from the well to storage tanks (not shown).

The internal diameter of the cylindrical passageway 22 is in the form of a stepped bore, which increases in diameter, stepwise, from the lower end to the upper end of the lower housing. A first, relatively short, bore 32 extends from the lower end of the lower housing to a first upwardly facing and outwardly extending annular shoulder 33 formed around the lower end of a lower bearing bore 34, the upper end of which includes an annular upwardly and outwardly extending tapered or chamfered section 36, which merges into a second upwardly facing annular shoulder 38 extending out to the lower end of a lower packing gland bore 40, which terminates at its upper end in an upwardly and outwardly extending annular tapered or chamfered section 42, which merges with the inner edge of a third upwardly facing and outwardly extending annular shoulder 44, which terminates at its outer periphery at the lower end of a lower seal-pusher bore 46, which terminates at the upper end of the lower housing.

An upper housing 50 includes a cylindrical body 51 with an elongated cylindrical passageway 52 extending through it.

The lower end of the upper housing is of reduced external diameter and has external threads 54 which screw into internal threads 56 in the inside of the upper end of the lower housing. A downwardly facing external annular shoulder 58 on the lower end of the upper housing and above threads 54 bears against the upper end of the lower housing and seals against an 0-ring 60 in an upwardly opening annular groove 62 in the upper end of the lower housing.

The upper housing includes an internal and downwardly facing annular shoulder 64 which merges at its inner periphery with the lower end of a longitudinally extending lubrication bore 66, which terminates at its upper end at the inner periphery of an internal upwardly facing annular shoulder 68, the outer periphery of which terminates at the lower end of an upwardly and outwardly extending internally threaded tapered bore 70, into which is threaded an annular upper bearing header 72, which has an internal and downwardly facing annular shoulder 73, which forms the upper end of an upper bearing bore 74 in the header.

The lower face of an annular guide holder 75 is secured by an annular weld 76 to the outer circumference of the upper end of the upper bearing header 72. An outwardly extending annular flange 77 on the guide holder 75 has longitudinally extending and internally threaded bolt holes 78, each of which receives a threaded bolt 79 that secures an annular retainer 80 to the upper face of the guide holder. An annular upwardly and inwardly extending frustoconical wiper 82 is clamped between the guide holder and the retainer. The upper end of the frustoconical wiper includes a central bore 84, which makes a close sliding seal around the polished rod 14 (shown only in phantom line in FIG. 2).

Starting at the lower end of the lower housing shown in FIG. 2, a cylindrical split bearing 90 in bore 34 rests on annular shoulder 33. The split bearing terminates at its upper end flush with annular shoulder 38. The split bearing is made of two identical semicylindrical wall segments 92, which fit together to form the cylindrical bearing 90 that makes a snug fit in bore 34. A separate outwardly opening semicircular groove 93 around the exterior of each wall segment of the split bearing receives a strip 94 of adhesive tape, which holds the two segments together. As shown in FIG. 2, the thickness of the tape is equal to, or slightly less than, the depth of groove 93 to facilitate insertion of the bearing into bore 34 when servicing the stuffing box, as described in detail below. The split bearing can be made of any suitable material, but I have found nylon to be satisfactory. The split bearing interior makes a close sliding fit against the exterior of the polished rod 14, which reciprocates in the longitudinal passageway extending through the stuffing box formed when the upper and lower housings are fitted together, as shown in FIG. 2, and when operated by the pump drive shown in FIG. 1.

An annular lower packing gland 95 makes a snug fit in bore 40 and rests on upwardly facing annular shoulder 38. A pair of 0-rings 96 in respective exterior annular grooves 97 in the outer surface of the lower packing gland make a static seal against the interior of bore 40 in the lower housing. The upper end of the lower packing gland is flush with the upwardly facing annular shoulder 44, and includes upwardly opening vertical threaded bores 98 adapted to receive a threaded tool (not shown) to facilitate pulling the lower packing gland out of bore 40 for maintenance work, as described below. A lower packing 100 in the lower packing gland makes a close sliding fit around the polished rod. The lower packing is a stack of annular strips 102 of conventional packing material (Lubrikup fluid-seal rod packing). As shown in FIG. 2, each strip is chevron-shaped in cross section, and each is disposed with the apex of the chevron pointing upwardly so that high-pressure fluid in the well forces each strip to spread and make a tight sliding seal against the polished rod and a tight static seal against the inner surface of the lower packing gland. The lower end of the lower packing rests on the upwardly facing shoulder 38 and the upper end of the lower split bearing 90. The upper end of the lower packing bears against the bottom of an outwardly extending flange 104 formed integrally on the lower end of a lower split nylon bushing 106 formed of two semicylindrical wall segments 108 to make a close sliding fit around the polished rod and a snug fit against an interior bore 110 of an annular lower seal pusher 112. The flange 104 is formed by a separate respective outwardly extending semiannular flange 113 on the lower end of each semicylindrical segment 108 of the split bushing.

The upper end of the lower seal pusher 112 includes a cylindrical section 114, which makes a close sliding fit within bore 46 of the lower housing. An inwardly extending annular flange 118 on the lower end of the lower seal pusher terminates at its inner periphery in a downwardly and longitudinally extending cylindrical hub 120, the lower end of which bears against an upwardly facing annular shoulder 122 on the outer periphery of annular flange 104 on the lower end of the lower nylon bushing.

The upper end of the lower seal pusher 112 bears against the outer periphery of the lower face 126 of an outwardly extending annular flange 128 formed integrally with the lower end of an annular upper seal pusher 130. The upper end of the upper seal pusher makes a close sliding fit in the lower end of an annular upper packing gland 131, which makes a snug fit in a cylindrical bore 132 in the upper housing. An 0-ring 133 in an outwardly opening annular groove 134 around the exterior of the upper seal pusher just above the flange 128 seals against a downwardly and outwardly tapering annular surface 135 on the interior of the lower end of the upper packing gland. The upper end of the upper packing gland bears against downwardly facing shoulder 64, and the lower end of the gland bears against the upper face of annular flange 128 on the upper seal pusher. A pair of annular 0-rings 136, each in a respective outwardly opening annular exterior groove 138 in the exterior of the upper packing gland, make a static seal against the interior of the upper housing. Downwardly opening vertical and internally threaded bores 139 in the lower end of the upper packing gland are adapted to receive the threaded tool (not shown) referred to above to facilitate pulling the upper gland out of the upper housing for servicing, as described below.

An upper packing 140 of packing rings 142 is disposed around the interior of the upper packing gland to make a close sliding fit against the polished rod when the rod is in the stuffing box, and to make a static seal against the interior of a cylindrical bore 143 in the upper packing gland. The upper packing is identical with the lower packing. The upper end of the upper packing bears against the inner periphery of downwardly facing shoulder 64 in the upper housing. The lower end of the upper packing bears against the upper face of an outwardly extending annular flange 144 on the upper end of an upper split nylon bushing 146 constructed as described above for the lower bushing 106.

Figure 3:
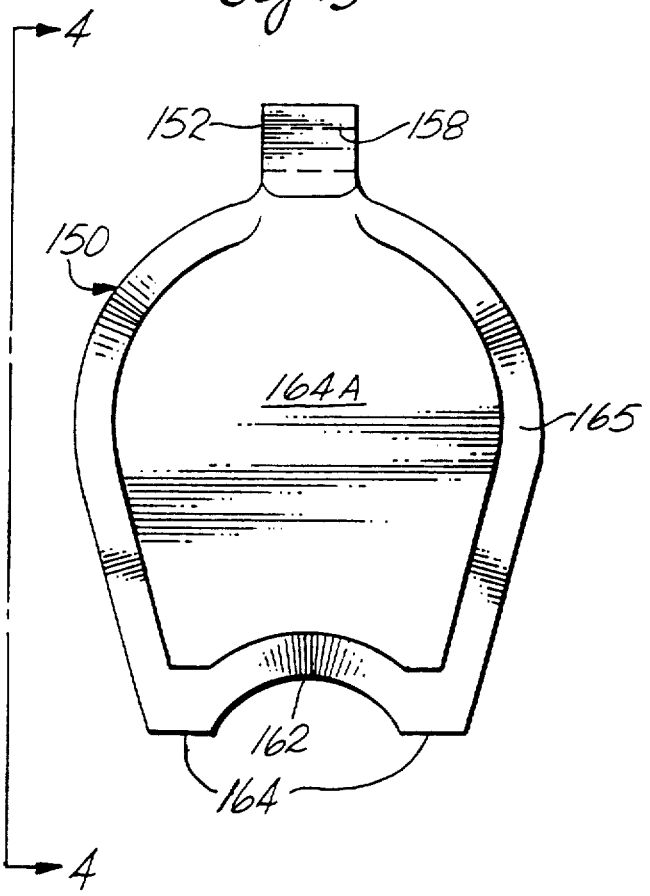
FIG. 3 is a view of the valve flap taken on line 3—3 of FIG. 2.

A valve flap 150 has an outwardly extending tab 152 (see FIG. 3) at its periphery. The tab 152 is disposed in an outwardly opening and radially extending notch 154 in the periphery of the lower portion of the upper seal pusher. A horizontal dowel or pivot pin 156 makes a press fit through collinear bores 158 in the upper seal pusher on opposite sides of notch 154, and a loose fit through bore 159 in the tab so the valve flap is free to pivot between the solid- and phantom-line positions shown in FIG. 2.

Figure 4:
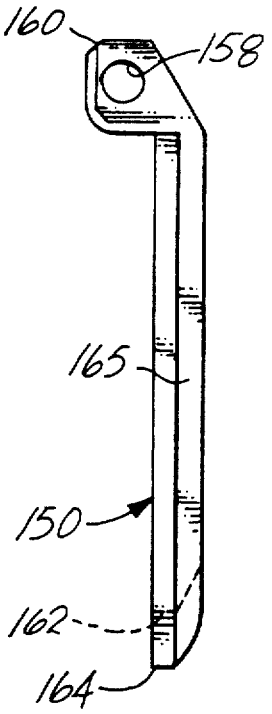
FIG. 4 is a view taken on line 4—4 of FIG. 3.

The tab includes a stop portion 160 (FIG. 4), which engages the inner end of radial notch 154 when the flap 150 hangs down in the phantom-line position shown in FIG. 2, i.e., at an angle of about 20° from vertical so the flap extends downwardly and inwardly.

Part of the valve flap periphery diametrically opposed from the tab and pin 156 includes an arcuate cutout portion 162 (FIG. 3), which makes a close fit around the part of the polished rod nearest the side of the stuffing box on which the pivot pin 156 is located. Thus, when the pumping system is in normal operation, a pair of ears 164 (FIG. 3) on opposite sides of the arcuate cutout portion 162 of the valve flap 150 extend part way into what would be the path of fluid flow if the polished rod breaks and drops below the lower packing, as described below. If the sucker rod breaks and drops down through the lower packing, fluid which may tend to flow up through the well strikes the underside of the ears and carries the valve flap up so a central sealing area 164A of the valve flap seals against an annular O-ring 166 in a downwardly opening annular groove 168 in the lower face of the upper seal pusher 130. The higher pressure on the underside of the valve flap keeps the valve closed to prevent loss of fluid from the well. The valve flap is beveled to a border 165 around its edges on the lower (as viewed in the closed position in FIG. 2) face. This reduces the mass of the flap and directs fluid flow to ensure rapid response to the closing force, and yet provides substantial strength to the flap in the central portion, which is subjected to maximum force when the valve snaps shut.

A first conventional lubricant fitting 170, which may be of the Alemite type, is threaded into an internally threaded bore 172 extending through the sidewall of the lower housing. Bore 172 is collinear with a bore 174 in the cylindrical section 114 of the lower seal pusher. The annular space between the polished rod (when it is in the stuffing box), and the interior of the upper seal pusher forms a central lubrication chamber 175, which can be filled with lubricant (not shown) under pressure to ensure adequate lubrication of the lower end of the upper packing and the upper end of the lower packing as the polished rod reciprocates through those packings. Oil (not shown) pumped from the well lubricates the lower end of the lower packing. A fitting 180 for a pressure gauge (not shown) is threaded into a threaded bore 182 extending through the lower housing. Bore 182 is collinear with a bore 184 extending through the upper seal pusher so that pressure within the central lubrication chamber can be sensed with conventional equipment (not shown) to send an alarm signal when pressure of the lubricant in the central lubrication chamber drops below, or rises above, a required range.

A second lubricant fitting 190 is threaded into a bore 192 extending through the upper housing wall and opening into a second annular lubrication chamber 194 around the polished rod and between the upper end of the upper packing and the lower end of the upper split bearing. Thus, lubricant (not shown) can be injected into the second lubricating space 194 to provide adequate lubrication for the upper end of the upper packing, which could burn out prematurely if not properly lubricated.

A pressure gauge fitting 196 is threaded into a bore 198 extending through the upper housing wall and also opening into the upper annular lubricating space 194 so that a pressure gauge (not shown) secured to the pressure gauge fitting 196 can monitor the lubricating space 194 to ensure proper lubricant pressure is maintained. Under normal operating conditions, the lower packing prevents the well pressure from reaching the upper packing and the two lubricating chambers. Accordingly, the pressure within the second lubricating space 194 need not be very high. For example, a pressure of 2 to 10 psi is normally adequate for the upper lubricating space, and is easily confined by the wiper at the upper end of the box.

ASSEMBLY OF THE STUFFING BOX

The stuffing box of this invention can easily be assembled on a polished rod, which is to be connected to a string of sucker rods in a well. For example, the polished rod can be suspended in the well and connected at its lower end to the upper end of a string of sucker rods (not shown). The polished rod is clamped so that the upper end of the rod extends above the wellhead. The upper end of the polished rod is temporarily disconnected from the pumping cable 12. The lower end of the lower housing is slipped down over the upper end of the polished rod and threaded into the wellhead tee 30. During this stage of the assembly, the lower packing makes a relatively loose slip fit around the polished rod to facilitate locating the lower housing in proper position.

The lower end of the upper housing is then slipped down over the upper end of the polished rod so that the external threads 54 on the lower end of the upper housing engage the internal threads 56 in the upper end of the lower housing, permitting the two housings to be screwed together to the position shown in FIG. 2. As the upper housing moves into the final position shown in FIG. 2, the downwardly facing internal shoulder 64 of the upper housing forces the upper packing and packing gland downwardly against the outwardly extending flange of the upper bushing and against the upper face of the outwardly extending flange on the lower end of the upper seal pusher, which engages the upper end of the lower seal pusher and drives the cylindrical hub 120 of the lower seal pusher down against the outwardly extending flange on the lower split bushing 106, which, in turn, compresses the lower packing against the shoulder 38 and the upper end of the lower split nylon bearing.

In a typical installation, each uncompressed stack of packing is about 3" high, and is compressed about $\frac{1}{8}$" to a final height of about $2\frac{7}{8}$". A hard squeeze is not required on either packing because the wellhead pressure will cause the lower packing to set to the required force to contain well fluid within the well until the lower packing becomes excessively worn.

In assembling the stuffing box as just described, the split nylon bearings and bushings on opposite sides of the upper and lower packings ensure collinear alignment of the longitudinal axis of the polished rod with the collinear longitudinal axes of the upper and lower packings. The upper end of the polished rod is then connected by conventional adjustable means to the pumping system so that the polished rod reciprocates through the stuffing box with minimum friction and wear on the packing.

If the upper bearing header 72 was not already assembled with the upper housing, the header can be slipped down over the upper end of the polished rod and threaded into the position shown in FIG. 2 so that the wiper makes a firm seal against the polished rod.

After the upper and lower housings and the top bearing header are assembled as shown in FIG. 2, a longitudinally extending slot 200 is formed in the exterior surface of the upper end of the upper housing, and a longitudinal slot 202, collinear with slot 200, is formed in the exterior surface of the lower end of the upper housing. Either of the housings (in the case shown in FIG. 2, the upper housing) is drilled and tapped to provide an internally threaded bore 204, which receives a set screw 206 extending through a bore 207 in a longitudinal key 210 disposed in the collinear slots 200 and 202 to lock the two housings against inadvertent decoupling during the operation of the pump.

The upper and central lubrication chamber are filled with lubricant. The valve flap 150 hangs down in the phantom-line position shown in FIG. 2, and the stuffing box is now ready for well-pumping action, which is initiated by starting the pump drive system 10 to lift fluid from the well and pump it through gathering line 31.

The advantage of the invention just described is that the upper and lower packings are automatically compressed the optimum amount when the stuffing box is properly assembled, and require no further adjustment until maintenance is required, such as when the lower packing eventually fails. Thus, there is no danger that either of the packings can be set with, or changed to, a force too high or too low by field personnel exercising independent judgment.

Anytime the pressure of the lubricant in either of the chambers drops below a required amount, the pressure gauges connected to those two chambers provide an indication (for example, an automatic alarm by means not shown) that additional lubricant should be added through the appropriate lubricant fitting.

Eventually, the lower packing will fail, permitting well fluid under high pressure to flow into the central lubrication chamber and against the lower end of the upper packing, which is then set by the additional force to prevent leakage past that packing. At the same time, the pressure gauge connected to the central chamber indicates an abnormally high pressure, which is the signal that the stuffing box should be serviced promptly to replace the lower packing.

The stuffing box is serviced by shutting in the well (i.e., closing appropriate valves not shown), and opening valves (not shown) to relieve any pressure in the stuffing box.

The stuffing box is then disassembled by following the above steps in reverse order. The set screw 208 and the key 210 are removed so that the upper housing can be unscrewed and lifted from the lower housing. The lower seal pusher and the lower nylon flanged bushing 106 are pulled up from the interior of the lower housing. A threaded pulling tool (not shown) is threaded into bores 98 in the upper end of the lower packing gland, which is pulled from bore 40 to facilitate removing and replacing the lower packing.

If the lower split nylon bearing 90 needs replacing, it is pulled out of bore 34 and disassembled by cutting the tape 94 (if necessary) and removing the two split pieces from the polished rod. New split segments for a new split nylon bearing are placed around the polished rod and taped together so they can easily be inserted into the position shown in bore 34 of FIG. 2, and without having to disconnect the upper end of the polished rod from the pump cable, or remove the upper housing from the polished rod.

If the split nylon flanged bushing needs to be replaced, that is also done at this time. The upper split nylon flanged bushing, the upper packing, and the upper split bearing can all be inspected at this time to permit any required replacement.

The stuffing box is then reassembled as previously described to the condition shown in FIG. 2 so that pumping of the well can be resumed.

If the polished rod breaks, the pumping mechanism pulls the upper portion of the broken polished rod from the stuffing box (as shown in FIG. 1), and the lower portion of the broken polished rod drops down into the well, along with the string of sucker rods so that the lower portion of the broken polished rod drops below the lower packing. If fluids, such as oil or gas, tend to flow up through the stuffing box, those fluids engage the ears on the inner periphery of the valve flap 150 and immediately pivot it in a clockwise direction (as viewed in FIG. 2) about dowel pivot pin 156, causing the flap to snap shut against O-ring 166 and prevent loss of fluid from the well.

Figure 5:
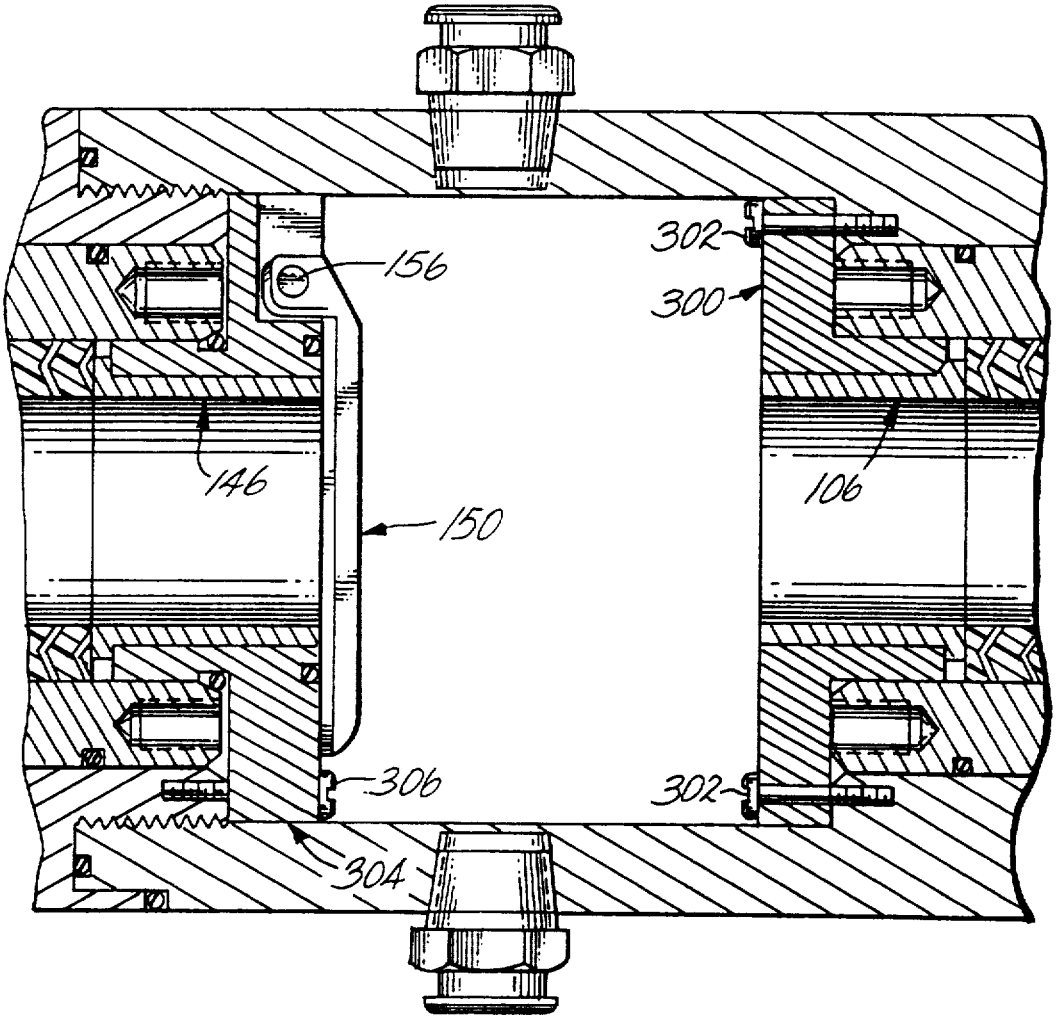
FIG. 5 is a fragmentary view similar to the central portion of FIG. 2 showing an alternate embodiment of the invention showing how the packing can be compressed before assembling the stuffing box.

FIG. 5 shows an alternate embodiment of the invention, which is similar to the embodiment described with respect to FIGS. 1–4. Like reference numerals are used in FIG. 5 to identify like elements in FIGS. 1–4. Referring to FIG. 5, an annular lower seal pusher 300 is secured by screws 302 to the upwardly facing shoulder 44 of the lower housing to compress the lower packing the required amount.

An annular upper seal pusher 304 is secured by screws 306 (only one screw is shown in FIG. 5) to the lower end of the upper housing to compress the upper packing the required amount.

The assembly, operation, and servicing of the stuffing box shown in FIG. 5 is similar to that of the box shown in FIGS. 1–4. The principal difference is that the upper and lower packings and are set by the screws 302 and 306 before the upper and lower housings are threaded together. Although the stuffing box shown in FIG. 5 has many of the advantages of the box shown in FIGS. 1–4, the disadvantage of the embodiment shown in FIG. 5 is that the upper packing is compressed by tightening screws 306 before the upper and lower housings are brought together. Therefore, once the upper packings are compressed, it is more difficult to slide the lower housing down the polished rod and engage the external threads of the upper housing with the internal threads of the lower housing.

Figure 6:
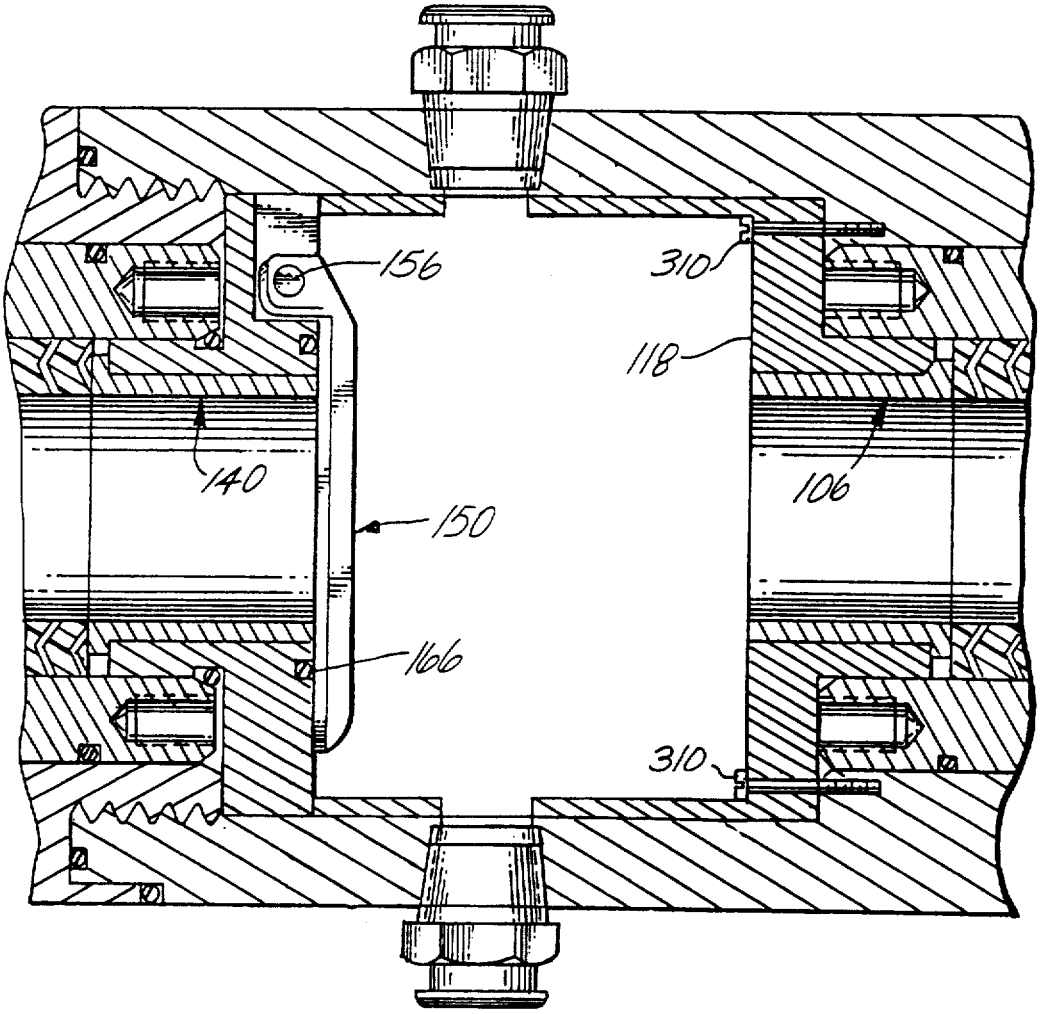
FIG. 6 is a fragmentary view similar to that of FIG. 5 showing another embodiment of the invention.

The disadvantage of the embodiment shown in FIG. 5 can be avoided by the embodiment shown in FIG. 6, which is similar to that shown in FIGS. 1–4, and where like reference numerals are used for like elements. The lower seal pusher 112 is identical with that shown in FIG. 2, except the lower seal pusher of FIG. 5 is secured by screws 310 to the upwardly facing shoulder 44 of the lower housing. Thus, with the embodiment of FIG. 6, the lower packing is properly set with screws 310. Thereafter, the upper housing and upper packing are slipped down the polished rod, and threaded into the upper end of the lower housing, causing the upper packing to be compressed the required amount by the lower seal pusher engaging the upper seal pusher, as described above with respect to the embodiment of FIG. 2.

If desired, the upper seal pusher of FIG. 6 can be secured to compress the upper packing, as with the embodiment shown in FIG. 5, and the lower packing compressed the required amount by threading the upper and lower housings together. If this latter procedure is followed, the upper housing is preferably first located at the appropriate place on the polished rod before the upper packing is set. The lower packing is then set by screwing the lower housing into the upper housing, and before the lower end of the lower housing is threaded into the wellhead. Thereafter, the polished rod and assembled stuffing box is lowered to engage the external threads on the lower end of the lower housing with the internal threads (not shown) of the wellhead to permit the stuffing box to be assembled to the condition shown in FIG. 1.

I claim:

1. A wellhead stuffing box for a reciprocating polished rod, the box comprising:

a) a body having an upright passageway extending through it and adapted to fit around a polished rod;

b) annular packing disposed in the passageway and adapted to make a sliding fit around the polished rod when the rod is in the passageway;

c) a valve seat carried by the body and extending around the passageway;

d) a valve flap mounted in the body to pivot about a substantially horizontal axis adjacent the valve seat, the valve flap having a central sealing area spaced from the pivot axis, and having peripheral section spaced farther from the pivot axis than the central sealing area, the peripheral section having a recessed portion spaced farther from the pivot axis than the sealing area and adapted to fit around part of the polished rod when the rod is in the passageway; and e) means for holding the valve flap so the recessed portion fits around part of the rod when the rod is in the passageway.

2. Apparatus according to claim 1 which includes stop means for holding the valve flap at an angle of about 20° from vertical so the flap extends downwardly and inwardly from the pivot axis when the rod is in the stuffing box.

3. A flap adapted to move between an open and a closed position with respect to a valve seat for a valve in a stuffing box, the flap including a substantially flat body having an opening extending through it to receive a substantially horizontal pivot pin to mount the valve flap in the stuffing box to be movable about a substantially horizontal pivot axis between the open and closed positions, the valve flap body having a central sealing area spaced from the pivot axis, and having peripheral section spaced farther from the pivot axis than the central sealing area, the peripheral section having an arcuate cutaway portion spaced farther from the pivot axis than the central sealing axis, the cutaway portion being constructed and arranged to fit around part of the polished rod when the polished rod is in the stuffing box, and stop means on the valve flap for engaging a portion of the stuffing box for holding the valve flap so the cutaway portion fits around part of the polished rod when the rod is in the box and the valve flap is in the open position.

* * * * *